US011583095B2

(12) United States Patent
De Ruiter et al.

(10) Patent No.: US 11,583,095 B2
(45) Date of Patent: Feb. 21, 2023

(54) PIECE OF SEATING FURNITURE

(71) Applicant: Beheermaatschappij Vermeulen Beesd B.V., Culemborg (NL)

(72) Inventors: Hugo De Ruiter, Boxtel (NL); Marinus Theodorus Antonius Vermeulen, Den Bosch (NL)

(73) Assignee: BEHEERMAATSCHAPPIJ VERMEULEN BEESD B.V., Culemborg (NL)

( * ) Notice: Subject to any disclaimer, the term of this patent is extended or adjusted under 35 U.S.C. 154(b) by 0 days.

(21) Appl. No.: 17/388,382

(22) Filed: Jul. 29, 2021

(65) Prior Publication Data

US 2022/0031081 A1 Feb. 3, 2022

(30) Foreign Application Priority Data

Jul. 31, 2020 (EP) ..... 20188854

(51) Int. Cl.
*A47C 4/02* (2006.01)
*A47C 17/04* (2006.01)
*A47C 7/40* (2006.01)

(52) U.S. Cl.
CPC ..... *A47C 17/04* (2013.01); *A47C 4/02* (2013.01); *A47C 7/40* (2013.01)

(58) Field of Classification Search
CPC ..... A47C 7/40; A47C 17/04; A47C 4/02
USPC ..... 297/440.16
See application file for complete search history.

(56) References Cited

U.S. PATENT DOCUMENTS 570,208 A * 10/1896 Harry ..... A47C 20/027 297/440.16
2,466,204 A * 4/1949 Brown ..... A47C 3/029 297/440.16
3,221,348 A * 12/1965 Siegel ..... A47C 7/42 297/440.16
3,704,911 A * 12/1972 Milakovich ..... A47C 4/02 297/440.16
4,437,704 A * 3/1984 Hovsepians ..... A47C 4/02 297/440.17
5,000,512 A * 3/1991 Laird ..... A47C 4/028 297/440.22
6,105,913 A * 8/2000 Couture ..... A47B 49/002 248/283.1
6,151,765 A * 11/2000 Asplund ..... B60N 2/7005 297/440.16

(Continued)

FOREIGN PATENT DOCUMENTS

DE G8400885.7 U1 5/1984
DE 29922846 U1 * 7/2000 ..... A47B 13/021

(Continued)

*Primary Examiner* — Rodney B White
(74) *Attorney, Agent, or Firm* — Flynn Thiel, P.C.

(57) ABSTRACT

A piece of seating furniture having a base member, on the upper side of which a padded seat surface is provided, and having at least one backrest member with an upholstered backrest surface, which can be positioned in various positions on the upper side of the base member. A slot structure is provided in the padded seat surface of the base member, which penetrates the padded seat surface, and furthermore a guide member is connected to the backrest member which projects through the upholstered seat surface in the area of the slot structure.

19 Claims, 5 Drawing Sheets

(56) References Cited

U.S. PATENT DOCUMENTS

| | | | | |
|---|---|---|---|---|
| 6,616,234 | B1 * | 9/2003 | King | A47C 7/42 297/440.16 |
| 8,721,000 | B2 * | 5/2014 | Nguyen | A47C 7/02 297/378.1 |
| 8,764,114 | B1 * | 7/2014 | Frank | A47C 7/42 297/440.16 |
| 9,259,089 | B2 * | 2/2016 | Nguyen | A47C 13/00 |
| 9,700,148 | B2 * | 7/2017 | Nguyen | A47C 1/024 |
| 9,723,931 | B2 * | 8/2017 | Lu | A47C 17/04 |
| 2008/0012416 | A1 * | 1/2008 | Richey | A47C 17/04 297/440.16 |
| 2012/0248835 | A1 * | 10/2012 | Williams | A47C 1/0303 297/232 |

FOREIGN PATENT DOCUMENTS

| | | | | |
|---|---|---|---|---|
| DE | 202005000852 | U1 | 6/2005 | |
| EP | 0701792 | A1 * | 3/1996 | A47C 17/04 |
| IT | MI199900399 | U | 12/2000 | |
| KR | 2021129978 | A * | 10/2021 | A47C 17/04 |

* cited by examiner

PIECE OF SEATING FURNITURE

CROSS-REFERENCE TO RELATED APPLICATION

This claims priority from European Application No. 20188854.2, filed Jul. 31, 2020, the disclosure of which is hereby incorporated by reference in its entirety.

FIELD OF APPLICATION

The invention relates to a piece of seating furniture, for example in the form of an armchair or a sofa.

BACKGROUND OF THE INVENTION

A usual piece of seating furniture in the form of an armchair or a sofa has a base member with an upholstered seat and a backrest which is usually also upholstered. The backrest of many known sofas or armchairs has a limited movement capability in relation to the seat, in particular it can be swivelled to achieve different sitting positions.

Also known are armchairs and sofas in which the backrest is not firmly connected to the base and the seat, but is designed in the form of a separate backrest member. However, such systems often have the disadvantage that the backrest member is not sufficiently fixed to the base so that it slips when in use.

SUMMARY OF THE INVENTION

It is an object of an embodiment of the present invention to provide a piece of seating furniture which allows flexibility in terms of use with improved stability.

A piece of seating furniture according to an embodiment of the invention has a base member, on the upper side of which a padded seat surface is provided, and at least one backrest member with an upholstered or padded backrest surface, which can be positioned in various positions on the upper side of the base member.

The backrest member can be enabled to be movable by a slot structure provided in the padded seat surface of the base member, which penetrates the padded seat surface. A guide member is connected to the backrest member which projects through the upholstered seat surface in the area of the slot structure.

According to an embodiment of the invention, it is thus provided that there is a connection between the base member and the backrest member by the guide member. The guide member protrudes into the slot structure and thus provides support to the backrest member. Preferably, each backrest member has only one single guide member being guided in a single slot.

The guide member of the backrest is preferably attached to the base member so that it cannot be separated from the base member without tools. The guide member is preferably a metal or wooden member, which is in particular firmly attached to a backrest support member and/or movable and especially pivotable to the base member. Preferably, the guide member is also attached such to the backrest member that the backrest member is immovable in relation to the guide member.

Preferably the guide member is fastened in an articulated manner to a fastening surface of the base member by at least one hinge device. Preferably the guide member is attached to the mounting surface so as to be rotatable about a vertical axis of rotation by the hinge device and to be rotatable about a horizontal axis of rotation by the same or a second hinge device.

The mobility around a horizontal axis can serve in particular the purpose of bringing the guide member into a vertical alignment in which rotation around the vertical axis is subsequently possible. This preferably serves the purpose of afterwards rotating the guide member into a rotational position from which the guide member can be moved into another individual slot of the slot structure.

The articulation device may have two separate joints for pivoting about the vertical and horizontal axes, wherein a lower joint is preferably the vertical joint while the upper joint is the horizontal joint. Alternatively, a single 3D joint may be used, in particular a ball joint.

Preferably, the guide member is fixedly attached to the backrest member. Consequently, the guide member and the backrest member are moved in fixed relative positions to each other when the guide member is rotated about the vertical axis or tilted about the horizontal axis.

The base member preferably has a base plate below the upholstered or padded upper side, the hinge device being attached to this base plate.

This base plate is preferably located quite deep in the base member, especially at a distance of not more than 20 cm from the ground and/or of more than 20 cm under the upper surface. The base plate is preferably used not only for the attachment of the hinge device and therefore of the guide member, but also as a support for the upholstery material and/or for the attachment of furniture feet of the piece of furniture. The base plate can in particular be a wooden plate.

In the simplest case, the slot structure may comprise only one single linear slot, which allows a horizontal displacement of the guide member and, preferably in at least one horizontal position, also a rotation of the guide member around a vertical axis. Also, a non-linear single slot is possible.

However, preferably the slot structure has at least one connection area in which at least three individual slots are linked together. With such a design, the guide member within the slot structure cannot only be moved between two opposite ends of the slot forming the slot structure, but can also be controlled in the connection area to determine into which individual slot the guide member shall enter to place the connected backrest member in a specific end position. This increases the flexibility in the arrangement of the backrest member.

Preferably the slot structure has at least two slots which cross in the connection area, so that at least four individual slots are brought together in the connection area.

In this design two slots form a kind of cross, preferably at a 90° angle to each other. The crossing point of the slots forms the connection area. If the guide member or a first vertical portion of which is arranged in this connection area, the guide member can be guided from the connection area into one of the four individual slots formed by the two crossed slots.

Preferably the connecting area of the slot structure is provided directly above at least one hinge device. Moreover, the guide member preferably has a linearly extended first portion which can be brought into a vertical orientation by the hinge, the linearly extended first portion having a sufficient length such that an end thereof remote from the hinge extends beyond the top surface of the base member in vertical orientation.

According to this embodiment, it is therefore provided that the guide member is located on the side of the base member and directly below the connection area. By aligning the longitudinally extending first portion of the guide member, it is then possible to align the guide member so that the first portion projects vertically upward from the hinge device and penetrates the seating surface in the connection area. In this position, the backrest member can then be rotated about the vertical axis and then swung into the area of the chosen individual slot until the backrest member reaches an intended target position.

The first portion of the guide member mentioned above is preferably followed by a second portion, especially a second linear portion, which is angled in relation to the first portion but is firmly connected to the first portion, wherein preferably an angle between the first and the second portions is between 120° and 170°. In this way a rigid guide member can be realized, which during use is mainly located quite far below the seat surface and therefore does not lower the seating comfort.

A piece of seating furniture according to an embodiment of the invention can be designed in particular as an armchair. In such a case, the armchair preferably has a base member with a square upper side, which is preferably divided into four quadrants, in particular by the slot structure with two crossing slots.

Furthermore, pieces of seating furniture with a non-square upper side are also possible, in which a backrest member is provided, which can only be displaced in a partial area of the upper side. Also included within the scope of an embodiment of the invention are pieces of seating furniture, in particular pieces of seating furniture in the form of a sofa, which have more than one backrest member which can be moved separately from one another.

BRIEF DESCRIPTION OF THE DRAWINGS

Further advantages and aspects of the invention result from the claims and from the following description of preferred embodiments of the invention, which are explained below using the figures.

DETAILED DESCRIPTION

Figure 1:
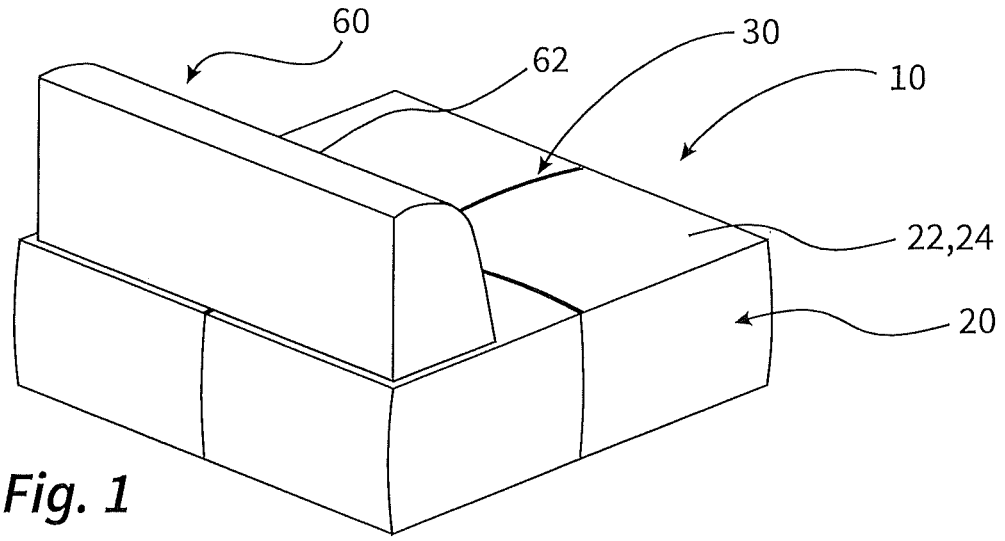
FIG. 1 shows a piece of seating furniture in the form of an armchair with backrest member.

FIG. 1 shows a first embodiment of a piece of seating furniture according to the invention. This piece of seating furniture 10 is designed as an armchair. The piece of seating furniture 10 has a base member 20, which has an essentially square upper side 22 that forms a seat surface 24, with the seat surface 24 being not covered by a backrest member 60.

Figure 2:
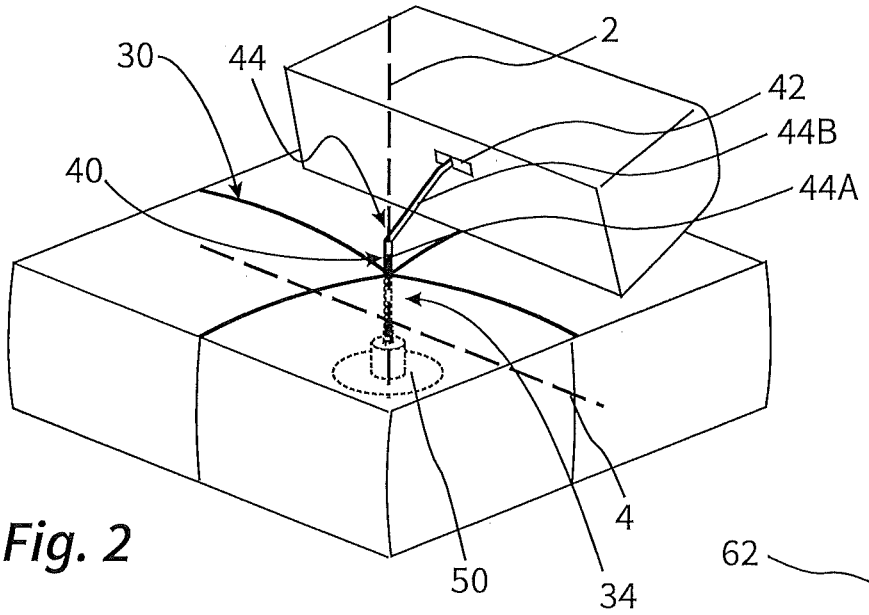
FIG. 2 shows the armchair of FIG. 1 during the transfer of the backrest member to another position.
Figure 3:
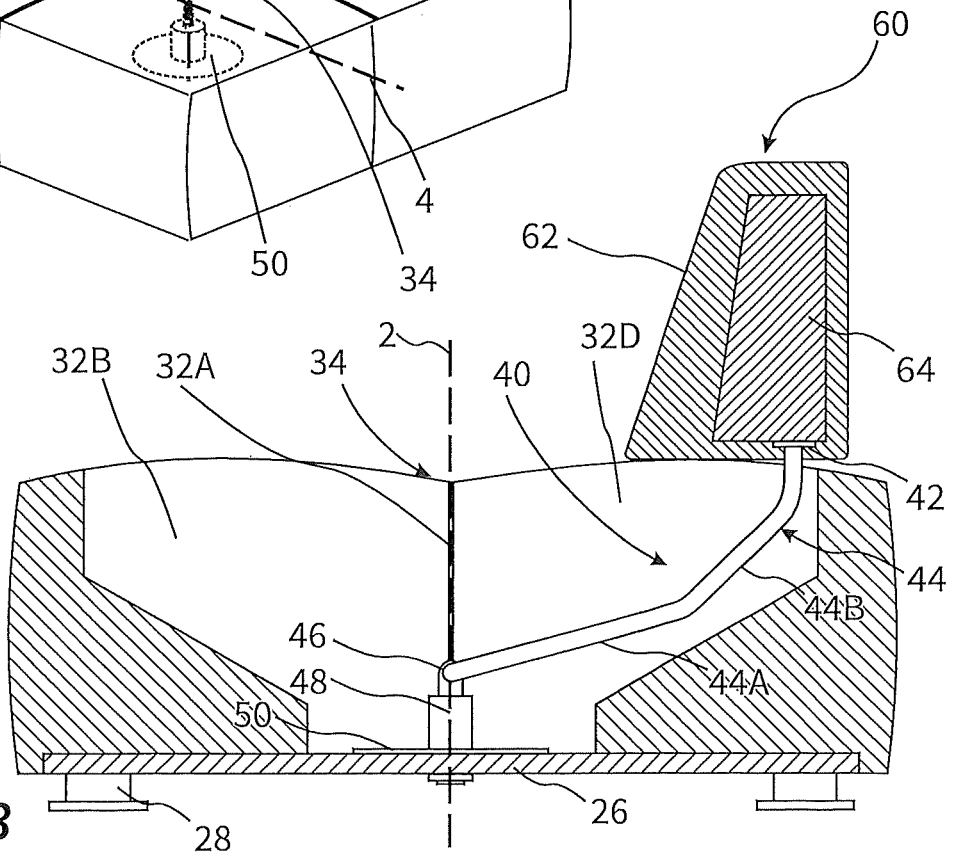
FIG. 3 shows the armchair in a sectional view.
Figure 4:
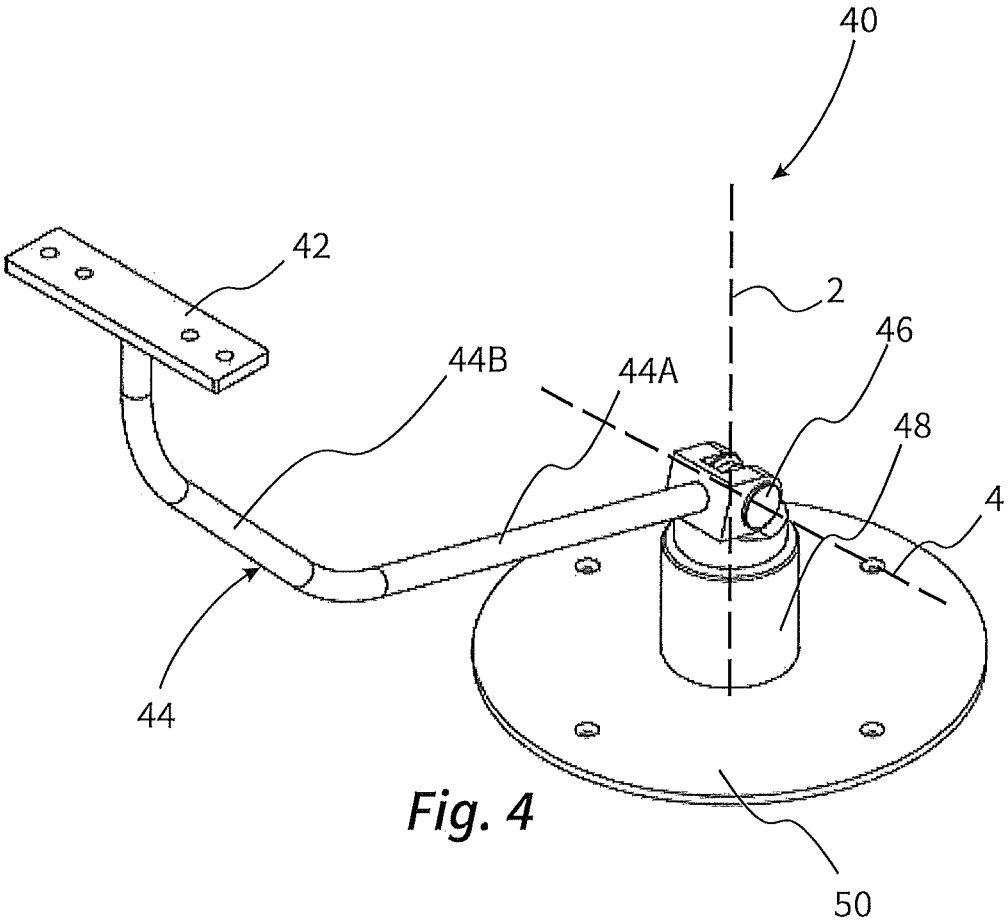
FIG. 4 shows a fitting part of the armchair, which also includes the guide member of the backrest member.

Referring to FIGS. 2 and 3, the backrest member 60 is shown connected to the base member 20. For this purpose, a backrest fitting 40 is provided centrally on a base plate 26 of the base member 20, to which furniture feet 28 are also attached. The backrest fitting 40 is also shown enlarged in FIG. 4. The fitting 40 has a mounting plate 50 which is attached to the base plate 26 and a distal attachment plate 42 fixed securely to the backrest member 60. Two joints 48, 46 are connected above the fastening plate 50. A vertical joint 48 enables a rotational movement about a vertical axis 2. Thus, a horizontal joint 46 provided above vertical joint 48 and all further parts of the backrest fitting 40 can thus be rotated about a vertical axis by the vertical joint 48. The horizontal joint 46 is a horizontally acting joint. By the horizontal joint 46, a guide member 44 follows the horizontal joint 46, which leads to the backrest member 60 or an inner stiff support 64 thereof covered by padding 62, being swivelled about a horizontal axis 4.

FIG. 2 shows the state in which the backrest member 60 is swivelled by about 80° about the horizontal axis 4 in relation to a starting position shown in FIGS. 1 and 3.

To be able to swivel the backrest member 60 together with the guide member 44, a slot structure 30 comprising slots 32 is provided in the base member 20. The illustrated slot structure 30 has two crossed slots in the example of FIGS. 1 to 3 and 5A to 5D, thus forming four individual slots 32A to 32D, which meet in a connection area 34. The connection area 34 is located directly above the joints 46, 48. This allows the user to choose freely to rotate the backrest member 60 about a vertical axis 2 and to choose in which of the individual slots 32A to 32D the guide member 44 is to be inserted, and where, as a result, the backrest member 60 is to be located.

This is illustrated in FIGS. 5A to 5D. In the state shown in FIG. 5A, the backrest member 60 is arranged in a first position. The guide member 44 is not visible in this position, as the guide member 44 is completely accommodated in the slot 32A in the manner illustrated in FIG. 3.

Figure 5A:
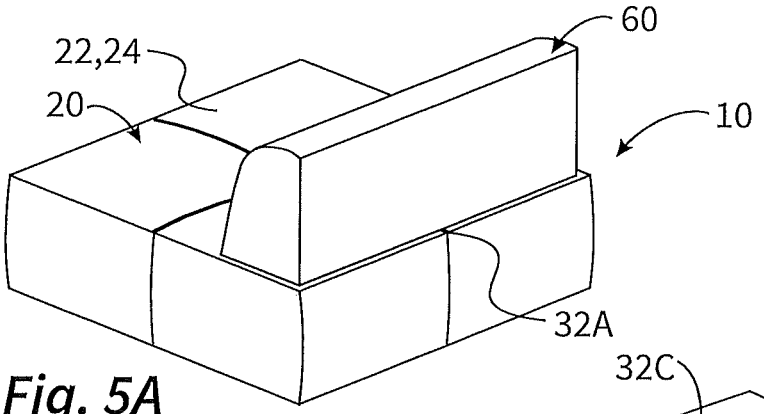
FIGS. 5A to 5D show the process of transferring the chair from a state with the backrest member in a first position to another state with the backrest member in a second position.
Figure 5B:
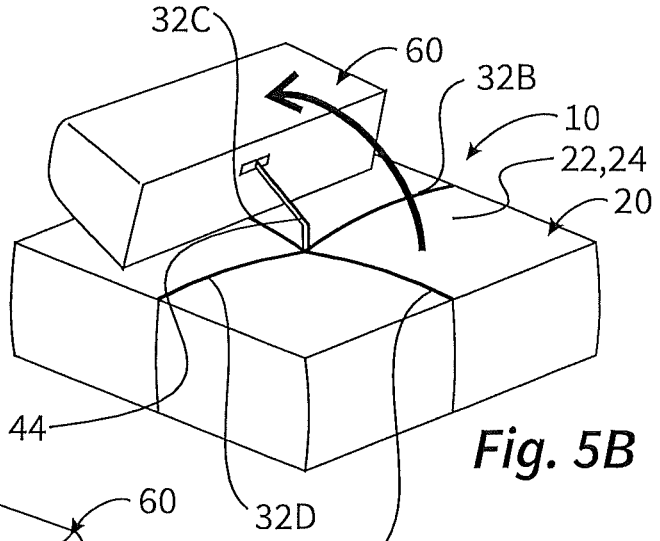
Figure 5C:
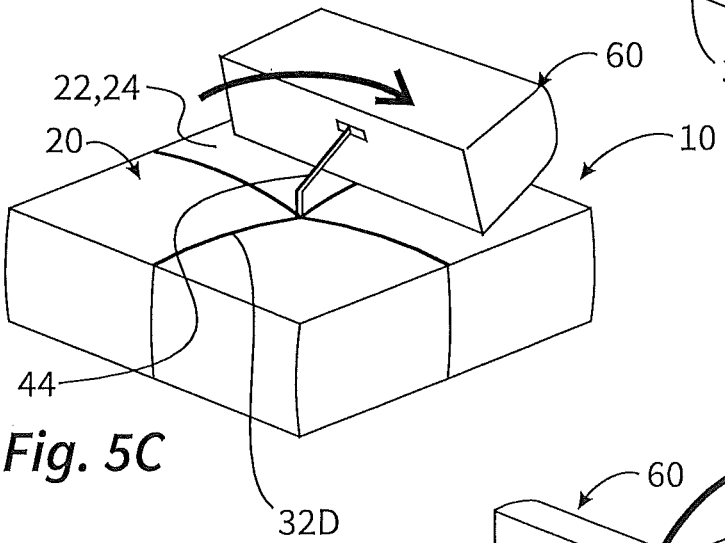
Figure 5D:
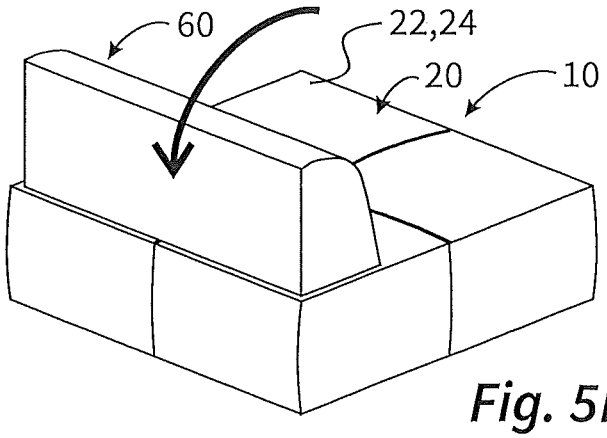

In order to change the configuration, the backrest member 60 together with the guide member 44 is swivelled up in the manner illustrated in FIG. 5B until a first portion 44A of the guide member 44 is vertically aligned and is located in the connection area 34 of the slot structure 30. Now the backrest member 60 together with the guide member 44 can be swivelled around the vertical axis in the manner illustrated in FIG. 5C by 90°. Then the backrest member 60 can be lowered again in the manner illustrated in FIG. 5D, whereby the guide member 44 is inserted into the single slot 32D. Once the condition of FIG. 5D is reached, the armchair can be used again. Due to the fact that the backrest member 60 is connected to the base plate 26 via the guide member 44, the piece of furniture is very stable. There is no danger of the backrest member 60 moving backwards when leaning against the backrest member 60.

FIGS. 6 to 8B show alternative embodiments.

Figure 6:
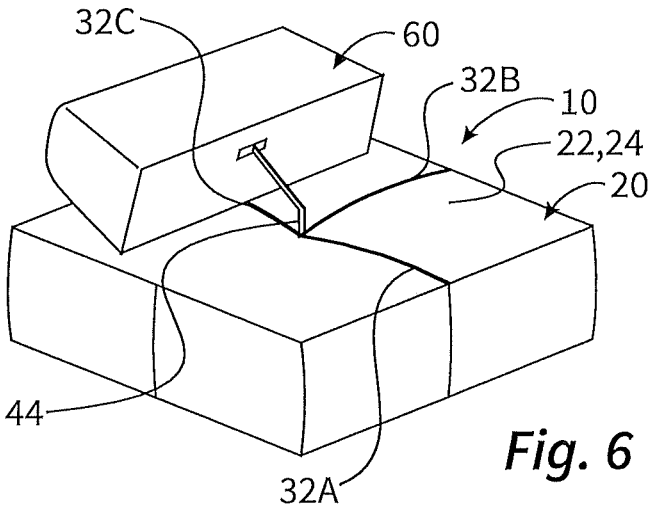
FIGS. 6 and 7 as well as 8A and 8B show alternative designs of a piece of seating furniture according to embodiments the invention.

In the construction according to FIG. 6, only three individual slots 32A, 32B, 320 are used instead of four individual slots. Accordingly, the backrest member 60 cannot take up four different positions, but only three different positions.

Figure 7:
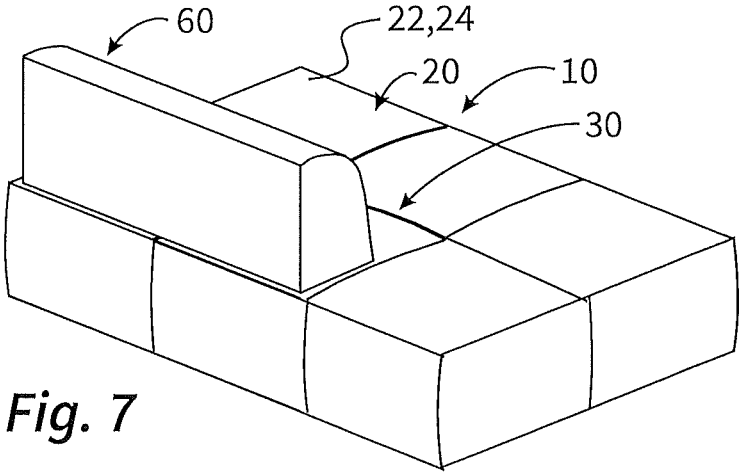

In the design according to FIG. 7, the piece of seating furniture 10 is configured such that the base member 20 does not have a square upper side 22, but a rectangular one. However, the slot structure 30 is still identical to that of FIGS. 1 to 3, so the backrest member 60 can be moved between four positions. However, parts of the upper side 22 of furniture 10 are not accessible for the backrest member 60.

Figure 8A:
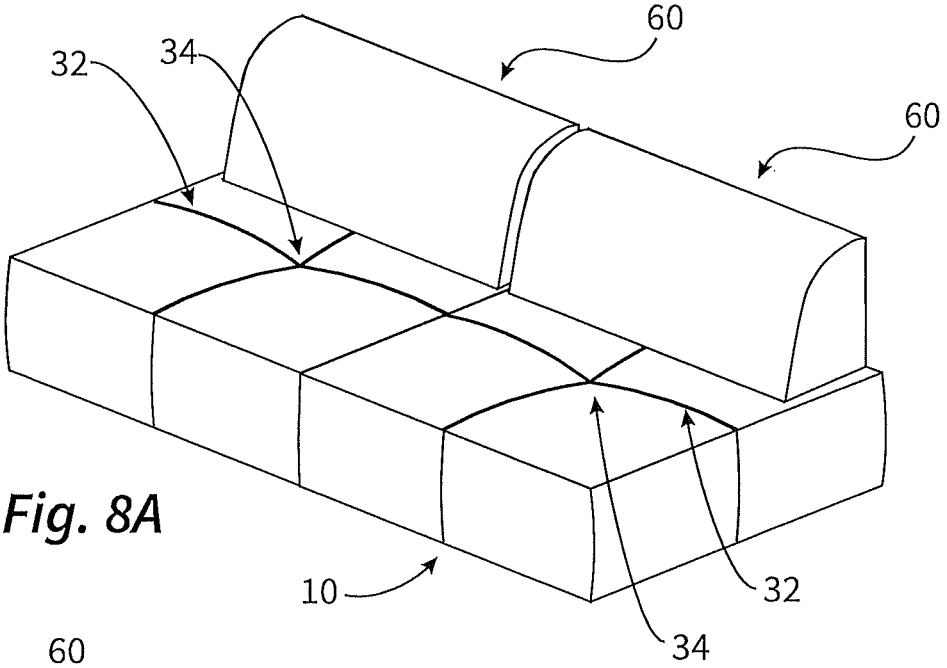
Figure 8B:
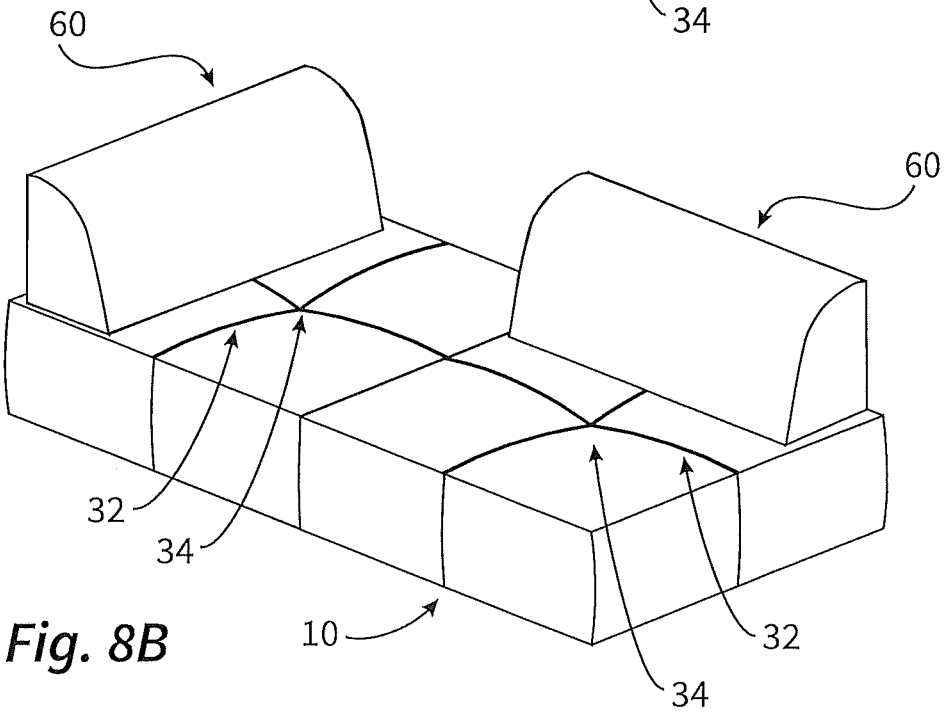

FIGS. 8A and 8B show two configurations of another example of the invention. This design example is a sofa 10 which has a design corresponding to that of two connected armchairs as shown in FIGS. 1 to 3. In this design, the two backrest members 60 are each provided with a guide member 44, which are connected to base plates 26 below the connection areas 34 in the manner already described. The two backrest members 60 can thus be brought into different positions independently of each other. FIG. 8B illustrates this by moving one of the backrest members 60 from the position along the long side according to FIG. 8A to the short front side.

The invention claimed is:

1. A piece of seating furniture comprising:

a base member, on an upper side of which a padded seat surface is provided;

at least one backrest member with a padded backrest surface, which can be positioned in various positions on the upper side of the base member;

a slot structure in the padded seat surface of the base member, which penetrates the padded seat surface; and a guide member connected to the at least one backrest member which projects through the padded seat surface in an area of the slot structure;

the guide member being fastened in an articulated or movable manner to a fastening surface of the base member by at least one hinge device;

the guide member being attached to the fastening surface so as to be rotatable about a vertical axis of rotation by the at least one hinge device; and the guide member being attached to the fastening surface so as to be rotatable about a horizontal axis of rotation by the at least one hinge device.

2. The piece of seating furniture according to claim 1, wherein:

the guide member is attached fixedly to the backrest member such that the guide member and the backrest member are moved in fixed relative position to each other when the guide member is rotated about the horizontal axis of rotation or about the vertical axis of rotation.

3. The piece of seating furniture according to claim 1, wherein:

the base member has a base plate below the upper side, the at least one hinge device being attached to this base plate.

4. The piece of seating furniture according to claim 1, wherein:

the slot structure has at least one connection area in which at least three individual slots are brought together.

5. The piece of seating furniture according to claim 4, wherein:

the slot structure has at least two slots which cross in the at least one connection area, so that at least four individual slots are brought together in the at least one connection area.

6. The piece of seating furniture according to claim 4, wherein:

the at least one connection area of the slot structure is provided above the at least one hinge device; and the guide member has a linearly extended first portion which can be brought into a vertical orientation by the at least one hinge device, the linearly extended first portion having a sufficient length such that an end thereof remote from the at least one hinge device extends beyond the padded seat surface of the base member in a vertical orientation.

7. The piece of seating furniture according to claim 1, wherein:

the at least one guide member is immovably attached to the backrest member.

8. The piece of seating furniture according to claim 1, wherein:

the upper side of the base member is substantially square.

9. A piece of seating furniture comprising:

a base member having an upper padded seat surface;

a backrest member with a padded backrest surface, the backrest member being able to be positioned in various positions on the upper padded seat surface of the base member;

a slot structure in the upper padded seat surface of the base member, the slot structure penetrating the upper padded seat surface; and a guide member connected to the backrest member, the guide member projecting through the slot structure in the upper padded seat surface;

the guide member comprising a movable joint system and being fastened to a fastening surface of the base member; and the movable joint system allowing the guide member to be rotatable about both a vertical axis of rotation and a horizontal axis of rotation at the movable joint system.

10. The piece of seating furniture according to claim 9, wherein:

the guide member is attached fixedly to the backrest member such that the guide member and the backrest member are moved in fixed relative position to each other when the guide member is rotated about the horizontal axis of rotation or about the vertical axis of rotation.

11. The piece of seating furniture according to claim 9, wherein:

the base member has a base plate below the upper padded seat surface, the base member having the fastening surface.

12. The piece of seating furniture according to claim 9, wherein:

the slot structure has an intersection in which at least two non-parallel individual slots are brought together.

13. The piece of seating furniture according to claim 9, wherein:

the slot structure has at least two slots which cross in a connection area so that at least four individual slots intersect in the connection area.

14. The piece of seating furniture according to claim 13, wherein:

the connection area of the slot structure is provided above a hinge device; and the guide member has a linearly extended first portion which can be brought into a vertical orientation by the movable joint system, the linearly extended first portion having a sufficient length such that an end of the linearly extended first portion remote from the movable joint system extends above the upper padded seat surface of the base member in the vertical orientation.

15. The piece of seating furniture according to claim 9, wherein:

the guide member is immovably attached to the backrest member.

16. The piece of seating furniture according to claim 9, wherein:

the upper padded seat surface of the base member is substantially square.

17. The piece of seating furniture according to claim 9, wherein:

the movable joint system includes a first hinge member allowing the guide member to be rotatable about the vertical axis of rotation and a second hinge member allowing the guide member to be rotatable about the horizontal axis of rotation.

18. The piece of seating furniture according to claim 9, wherein:

the movable joint system is located within the base member.

19. The piece of seating furniture according to claim 1, wherein:

the at least one hinge device comprises a first hinge member and a second hinge member, the first hinge member allowing the guide member to be rotatable about the vertical axis of rotation and the second hinge member allowing the guide member to be rotatable about the horizontal axis of rotation.

* * * * *